United States Patent [19]

Pringle

[11] Patent Number: 4,520,870

[45] Date of Patent: Jun. 4, 1985

[54] WELL FLOW CONTROL DEVICE

[75] Inventor: Ronald E. Pringle, Houston, Tex.

[73] Assignee: Camco, Incorporated, Houston, Tex.

[21] Appl. No.: 566,109

[22] Filed: Dec. 27, 1983

[51] Int. Cl.[3] ..... E21B 34/14

[52] U.S. Cl. ..... 166/317; 166/318; 166/332; 166/239; 251/319

[58] Field of Search ..... 166/317, 318, 316, 323, 166/332, 334, 242, 238, 239, 386, 373, 374, 376, 319, 125, 237; 137/70, 71; 251/318, 319

[56] References Cited

U.S. PATENT DOCUMENTS

| | | | |
|---|---|---|---|
| 2,379,079 | 6/1945 | Hayward | 166/318 |
| 2,586,015 | 2/1952 | Edwards | 166/239 |
| 3,054,415 | 9/1962 | Baker et al. | 166/318 |
| 3,275,080 | 9/1966 | Nelson et al. | 166/239 |
| 4,176,717 | 12/1979 | Hix | 166/318 X |

*Primary Examiner*—James A. Leppink
*Assistant Examiner*—Hoang C. Dang
*Attorney, Agent, or Firm*—Fulbright & Jaworski

[57] ABSTRACT

A well flow control device for use in an oil and/or gas well tubing string for communicating between the tubing string and the annulus. A tubular body having a plurality of openings with a sleeve telescopically movable in the interior of the body and initially covering and closing the openings. A plurality of dogs are carried by the sleeve in windows which taper upwardly and inwardly. The dogs include a ball which engages a backup shoulder in the body to hold the dogs inwardly when the sleeve covers the openings. The sleeve includes a shoulder engaging the balls for limiting the extent of the inward movement of the dogs and the body includes a recess to receive the dogs when the sleeve is moved to an opening position. Mechanical or hydrostatic shear releases are provided.

6 Claims, 6 Drawing Figures

Fig. 5
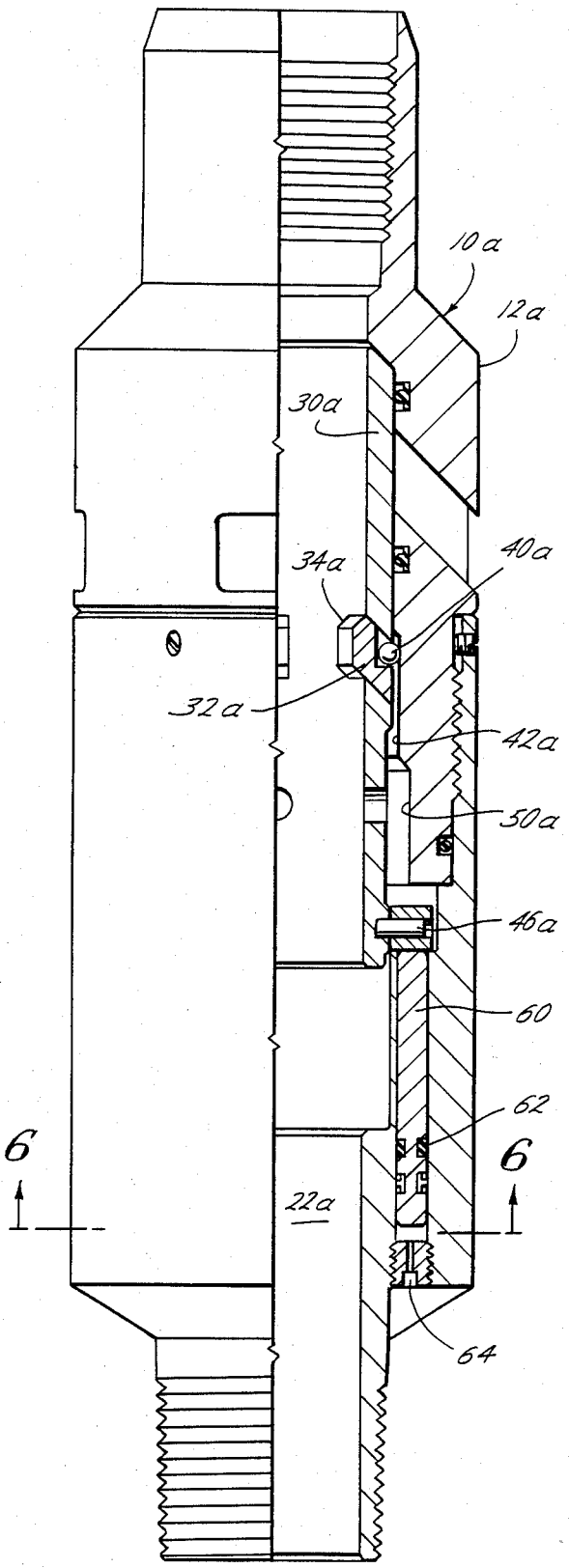
Fig. 3
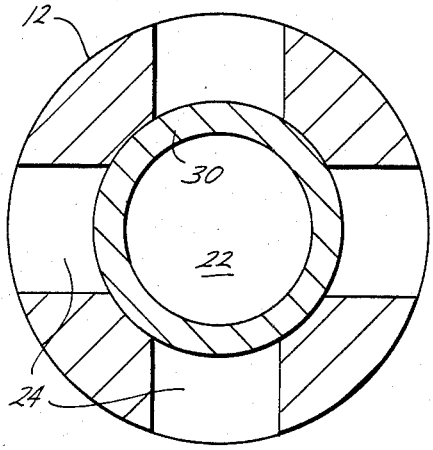
Fig. 4
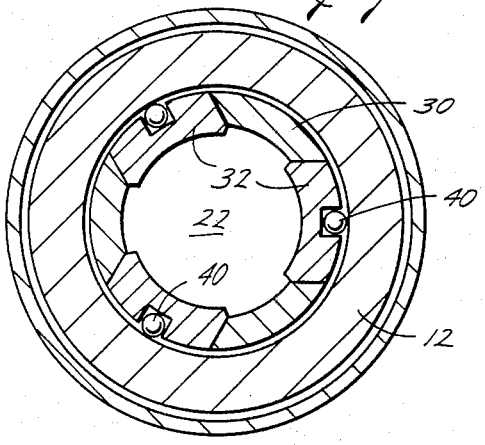
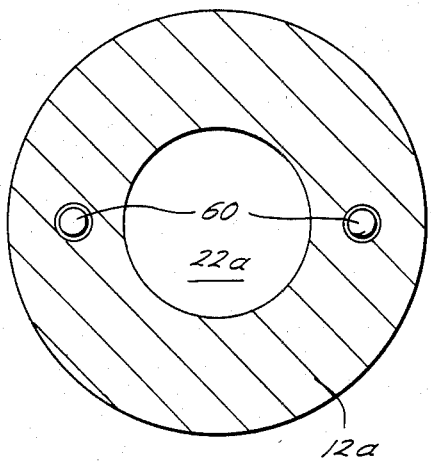
Fig. 6

WELL FLOW CONTROL DEVICE

BACKGROUND OF THE INVENTION

The present invention is directed to a well flow control device for use in an oil and/or gas well tubing string for communicating between the tubing string and the annulus. A sleeve is telescopically positioned in a body for initially covering and closing body openings and for opening the body openings when desired. It is desired to provide a minimal friction while shifting the sleeve. The present invention is directed to a sliding sleeve type of flow control device which is easily operable and provides a means of communicating between the tubing string and the well annulus and which may be released for operation in either a mechanical or hydraulic mode.

SUMMARY

The present invention is directed to a well flow control device for use in an oil and/or gas well tubing string for communicating between the tubing string and the annulus and includes a tubular body adapted to be connected in a tubing string in a well. The body includes a plurality of openings for communicating between the interior of the body and the outside of the body. A sleeve is telescopically movable in the body in the interior of the body and initially covers and closes the opening. At least one dog is carried by the sleeve and the dogs are movable outwardly from the sleeve towards the body. The body includes a backup shoulder positioned to hold the dogs inwardly when the sleeve is covering the opening for allowing a tool to engage the dogs, move the sleeve, and uncover the openings. The body includes a recess positioned to receive the dogs when the sleeve is moved to a position uncovering the openings. Releasable means such as shear means is provided between the sleeve and the body initially preventing moving of the sleeve relative to the body.

A still further object of the present invention is wherein the sleeve includes a window for each dog and the windows include tops and bottoms which taper upwardly and inwardly for supporting the dogs.

Still a further object is wherein each dog includes a ball on the outside of the dog and the ball initially engages the backup shoulder for holding the dogs inwardly and minimizes friction as the sleeve is moved. The sleeve includes a shoulder engaging the balls for limiting the extent of inward movement of the dogs. Preferably, the balls are of a softer material than the body for providing a bearing action.

Yet a further object of the present invention is wherein the body includes a seal about each opening and the body is recessed away from the sleeve except about the seals and the releasable means thereby limiting frictional contact between the body and the sleeve as the sleeve is moved.

Still a further object of the present invention is the provision of a hydraulic piston and a passageway in the body communicating pressure outside of the body to the piston. The piston is positioned to engage and actuate the releasable means such as a shear pin when the flow control device is moved downhole and encounters a sufficient hydrostatic pressure to actuate the releasable means.

Other and further objects, features and advantages will be apparent from the following description of presently preferred embodiments of the invention, given for the purpose of disclosure and taken in conjunction with the accompanying drawings.

BRIEF DESCRIPTION OF THE DRAWINGS

FIG. 3 is a cross-sectional view taken along the line 3—3 of FIG. 1, FIG. 4 is a cross-sectional view taken across the line 4—4 of FIG. 1, FIG. 5 is an elevational view, partly in cross section, of another embodiment of the present invention shown in the closed position, and FIG. 6 is a cross-sectional view taken along the line 6—6 of FIG. 5.

DESCRIPTION OF THE PREFERRED EMBODIMENT

While the present well flow control device will be described in connection with its use and application as a perforating production sleeve, this is for purposes of illustration only, as the present invention is useful in many types of applications.

Figure 1:
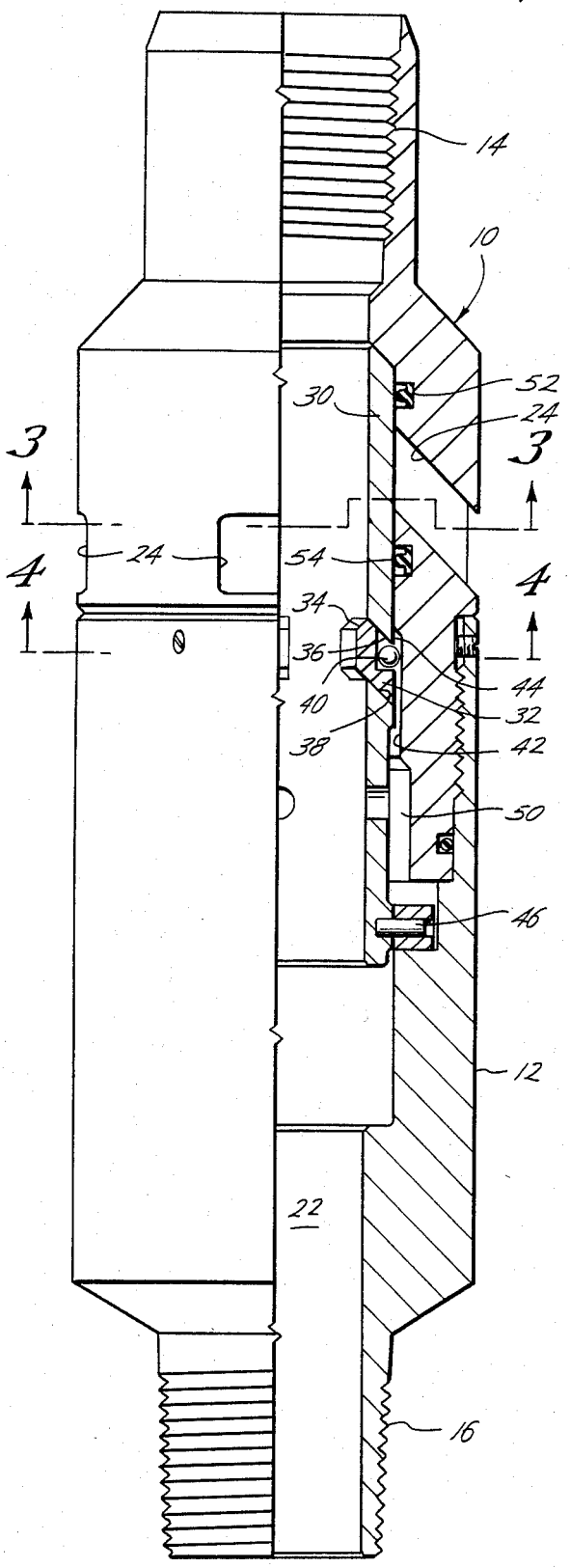
FIG. 1 is an elevational view, partly in cross section, of one embodiment of the present invention shown in the closed position.
Figure 2:
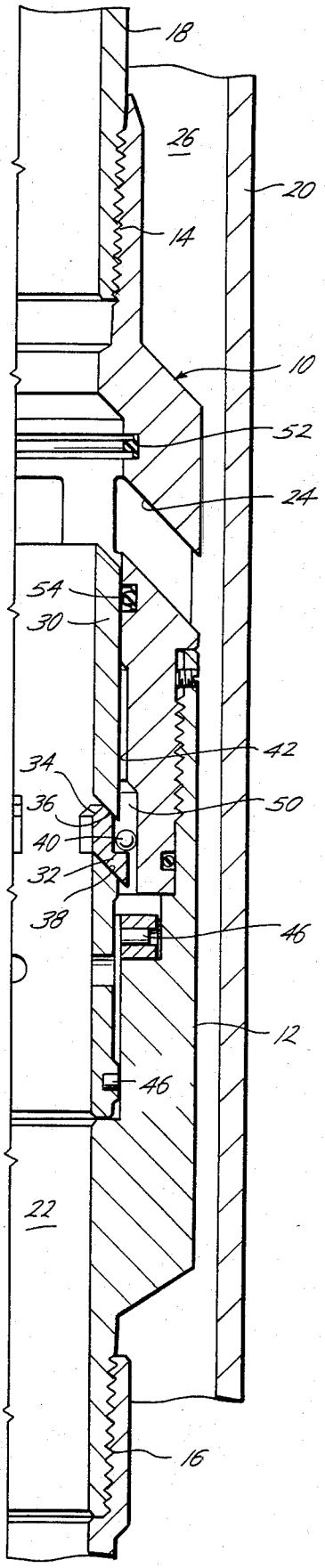
FIG. 2 is an elevational view in quarter section illustrating the apparatus of FIG. 1 in position in a tubing string and in the open position.

Referring now to the drawings, and particularly to FIGS. 1 and 2, the reference numeral 10 generally indicates the well flow control device of the present invention which generally includes a body 12 having upper 14 and lower 16 threaded connections for connection into a tubing string 18 which in turn is positioned in a casing 20 in a well. The body 12 includes a bore 22 and one or more openings 24 communicating between the interior bore 22 of the body 12 and the outside of the body 12 such as the annulus 26 between the tubing string 18 and the casing 20. A sleeve 30 is telescopically movable in the interior in the body 12 and initially covers and closes the openings 24 whereby there is no communication between the bore 22 and the outside of the body 12. Movement of the sleeve 30 downwardly, as best seen in FIG. 2, opens communication between the inside and the outside of the body 12.

At least one, and preferably a plurality of dogs 32, are carried by the sleeve 30. The dogs 32 include a shoulder 34 which extends inwardly from the sleeve 30 into the bore 22 for engagement by an actuating tool for moving the dogs 34 and thus the sleeve 30 downwardly. The dogs 32 are movably carried in windows in the sleeve 30 in which the windows include tops 36 and bottoms 38 which taper upwardly and inwardly for supporting a dog 32. The tapering top and bottoms 36 and 38 aid in supporting the dogs 32 and in moving the sleeve 30 downwardly upon impact of a tool on the shoulder 34. It is desirable that a minimum friction be encountered in shifting the sleeve 30. Thus, each dog 32 includes a ball 40 on the outside of the dog 32. The ball 32 initially, as best seen in FIG. 1, engages a backup shoulder 42 in the body 12. The backup shoulder 42 is positioned to hold the dogs 32 inwardly when the sleeve 30 is covering the openings 24 to insure that the shoulder 34 is extended into the bore 22 so that a tool may engage the shoulder 34, move the sleeve 30, and uncover the openings 24. Furthermore, the engagement of the ball 40 on the shoulder 42 reduces the friction of moving the sleeve 30. The sleeve 30 also includes a shoulder 44 which engages the balls 40 to limit the extent of inward movement of the dogs 32 and prevents them from falling out of the sleeve 30 and into the bore 22.

Releasable means such as a shear pin 46 is provided between the sleeve 30 and the body 12 for initially preventing movement of the sleeve 30 relative to the body as the tubing string 18 is moved downhole in the casing 20. After any suitable conventional tool is moved down the bore 22 to engage the shoulder 34 and shear the pin 30 the sleeve 30 is moved downwardly, as best seen in FIG. 2, until the balls 40 and the dogs 32 move off of the backup shoulder 42 and are positioned in a recess 50. The recess is positioned to receive the dogs 32 when the sleeve 30 is moved to a position uncovering the openings 24. This also allows the shoulders 34 of the dogs 32 to move outwardly and avoid obstructing the bore 22 after the flow control device 10 has been opened.

Preferably, the body 12 includes seals 52 and 54 about the openings 24. It is noted that it is preferable that the body 12 be recessed away from the sleeve 30 except adjacent the seals 52 and 54 and the connection of the shear pin 46. This reduces the sliding frictional contact between the sleeve 30 and the body 12. Additionally, the bearing or ball 40 is preferably of a softer material than the body 12 such as being a brass ball while the body 12 is of steel thereby providing a better bearing and less friction surface as the sleeve 30 is actuated.

Referring now to FIG. 5, another embodiment is shown wherein like character references shown in FIG. 1 refer to like parts with the addition of the suffix "a". Generally, the well flow control device **10*a* is similar to the device 10 with the exception that while the shear pin 46 in device 10 is sheared mechanically by a tool contacting shoulder 34 on the dogs 32, the shear pin or pins 46*a* are sheared by hydrostatic hydraulic forces. That is, one or more pistons 60 are provided in the body 12*a* having piston seals 62. The piston 60 is exposed to fluid pressure in the annulus 26 through a passageway 64 and to the pressure in the bore 22. The amount of force exerted by the piston 60 depends upon the hydrostatic forces in the annulus 26 of the well and thus depends upon the depth at which the device 10*a* is placed. Therefore, by selecting the size of a pin or pins 46*a* which will shear at a desired depth, the piston 60 will shear the pin at the desired depth and the mechanical tool need only shift the sleeve 30*a* and need not be required to shear the pin 46*a***.

In operation as a perforating production sleeve, the control device 10 or **10*a* is placed into the tubing string 18 just below a packer and above a perforating device (not shown). The tubing string 18 is run into the casing 20 in a closed position and the bore 22 is dry as fluid is displaced while lowering the tubing string 18 due to a rupture disc (not shown) placed between the control device 10 and the perforating device. Thus bore 22 is at atmospheric pressure. This type of completion technique is used to prevent completion fluid from entering the well formation after perforating the casing 20. The packer is set and the apparatus 10 is in the closed position with the sleeve 30 closing the openings 24. When it is desired to open the openings 24 for allowing permanent production from the annulus 26 to flow through the openings 24 and into the bore 22, an activating tool or bar is dropped from the surface and punctures the disc after passing through the sleeve 30 and contacting the shoulder 34 of the dogs 32 to shear the shear pin 46 in the case of the embodiment of FIGS. 1 and 2 and move the sleeve 30 downwardly into the open position as best seen in FIG. 2. In case of the embodiment of FIG. 5, the device 10*a* will have its shear pin 46*a* sheared by the piston 60 in response to hydrostatic forces existing in the annulus due to the differential pressure created by the fluid head in the annulus 26 and the atmospheric pressure in the bore 22. However, the sleeve 30*a* will not be shifted until mechanically moved by an activating tool moving the shoulders 34*a* of the dogs 32*a***.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts, will readily suggest themselves to those skilled in the art and which are encompassed within the spirit of the invention and the scope of the appended claims.

What is claimed is:

1. A well flow control device for use in an oil and/or gas well tubing string for communicating between the tubing string and the annulus comprising, a tubular body adapted to be connected in a tubing string in a well, said body having a plurality of openings for communication between the interior of the body and the outside of the body, a sleeve telescopically movable in the interior of the body and initially covering and closing said openings, at least one dog carried by the sleeve, said dogs movable outwardly from the sleeve towards the body, said body including a backup shoulder positioned to hold the dogs inwardly when the sleeve is covering said openings for allowing a tool to engage said dogs, move the sleeve, and uncover the openings, said body including a recess positioned to receive the dogs when the sleeve is moved to a position uncovering said openings, releasable means between the sleeve and the body initially preventing moving of the sleeve relative to the body, and the sleeve includes a window for each dog, said windows having tops and bottoms which taper upwardly and inwardly for supporting said dogs.

2. The apparatus of claim 1 wherein each dog includes a ball on the outside of the dog, said ball initially engaging said backup shoulder for holding the dogs inwardly and minimizing friction as the sleeve is moved.

3. The apparatus of claim 2 wherein the sleeve includes a shoulder engaging said balls for limiting the extent of inward movement of said dog.

4. The apparatus of claim 3 wherein the ball is of a softer material than the body.

5. A well flow control device for use in an oil and/or gas well tubing string for communicating between the tubing string and the annulus comprising, a tubular body adapted to be connected in a tubing string in a well, said body having a plurality of openings for communication between the interior of the body and the outside of the body, a sleeve telescopically movable in the interior of the body and initially covering and closing said openings, at least one dog carried by the sleeve, said dogs movable outwardly from the sleeve towards the body, said body including a backup shoulder positioned to hold the dogs inwardly when the sleeve is covering said openings for allowing a tool to engage said dogs, move the sleeve, and uncover the openings, said body including a recess positioned to receive the dogs when the sleeve is moved to a position uncovering said openings, releasable means between the sleeve and the body initially preventing moving of the sleeve relative to the body, a hydraulic piston, and a passageway in the body communicating pressure outside of the body to the piston, said piston positioned to engage and actuate the releasable means when the flow control device is moved downhole and encounters a sufficient hydrostatic pressure to actuate the releasable means.

6. A well flow control device for use in and oil and/or gas well tubing string for communicating between the tubing string and the annulus comprising, a tubular body adapted to be connected in a tubing string in a well, said body having a plurality of openings for communicating between the interior of the body and the outside of the body, a sleeve telescopically movable in the interior of the body and initially covering and closing said openings, a plurality of dogs carried by the sleeve, said sleeve including a window for each dog, said windows having tops and bottoms which taper upwardly and inwardly for supporting said dogs, each dog including a ball on the outside of the dog, said body including a backup shoulder positioned to engage the balls and hold the dogs inwardly when the sleeve is covering said openings for allowing a tool to engage said dogs, move the sleeve, and uncover the openings, said sleeve including a shoulder engaging said balls for limiting the extent of inward movement of said dog, said body including a recess positioned to receive the dogs when the sleeve is moved to a position uncovering said openings, and releasable means between the sleeve and the body initially preventing moving of the sleeve relative to the body.

* * * * *